US011435073B2

(12) United States Patent
Feng et al.

(10) Patent No.: US 11,435,073 B2
(45) Date of Patent: Sep. 6, 2022

(54) COMBINED LAMP AND BLADELESS FAN

(71) Applicant: OPPLE LIGHTING CO., LTD., Shanghai (CN)

(72) Inventors: Xuejun Feng, Shanghai (CN); Yueping Wang, Shanghai (CN); Zhonghua Sui, Shanghai (CN); Shitao Deng, Shanghai (CN)

(73) Assignee: Oppie Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/138,871

(22) Filed: Dec. 30, 2020

(65) Prior Publication Data

US 2021/0116123 A1 Apr. 22, 2021

Related U.S. Application Data

(63) Continuation of application No. PCT/CN2019/096413, filed on Jul. 17, 2019.

(30) Foreign Application Priority Data

Jul. 24, 2018 (CN) ..... 201810821894.9
Jul. 24, 2018 (CN) ..... 201821178486.8

(51) Int. Cl.
*F21V 33/00* (2006.01)
*F21V 7/24* (2018.01)
(Continued)

(52) U.S. Cl.
CPC ..... *F21V 33/0096* (2013.01); *F04D 25/08* (2013.01); *F21S 8/04* (2013.01);
(Continued)

(58) Field of Classification Search
CPC ..... F21V 29/60; F21V 29/63; F21V 29/67; F21V 29/673; F21V 29/677;
(Continued)

(56) References Cited

U.S. PATENT DOCUMENTS 6,551,185 B1 * 4/2003 Miyake ..... F24F 1/0038 454/233
9,335,061 B2 * 5/2016 Avedon ..... F04D 29/542
(Continued)

FOREIGN PATENT DOCUMENTS

CN 105570096 A 5/2016
CN 205446103 U 8/2016
CN 108826146 A 11/2018

OTHER PUBLICATIONS

International Search Report of PCT Application No. PCT/CN2019/096413 dated Oct. 23, 2019 with English translation, (4p).

*Primary Examiner* — Alexander K Garlen
(74) *Attorney, Agent, or Firm* — Arch & Lake LLP

(57) ABSTRACT

A lamp includes an air supply and a lighting module. The air supply includes an air blower and an annular housing, the annular housing defines an annular region and has an inner ring surface, an outer ring surface, a first end surface and a second end surface which are connected with the inner ring surface and the outer ring surface and face away from each other. The lighting module is disposed at a side of the annular housing which is close to the first end surface and is located within a projection range of the annular region at the side, and the lighting module emits light rays towards the side faced by the first end surface.

20 Claims, 4 Drawing Sheets

(51) Int. Cl.
*F21S 8/04* (2006.01)
*F04D 25/08* (2006.01)
*F24F 13/078* (2006.01)

(52) U.S. Cl.
CPC ..... *F21V 7/24* (2018.02); *F24F 13/078* (2013.01); *F24F 2221/02* (2013.01)

(58) Field of Classification Search
CPC . F21V 33/0092; F24F 13/078; F24F 2221/02; F04D 25/088
See application file for complete search history.

(56) References Cited

U.S. PATENT DOCUMENTS

| | | | | |
|---|---|---|---|---|
| 2015/0022996 | A1* | 1/2015 | Kang | F24F 13/078 362/23.14 |
| 2015/0153062 | A1* | 6/2015 | Kim | A61N 5/0618 62/132 |
| 2015/0176834 | A1* | 6/2015 | Avedon | F04D 25/088 415/121.3 |
| 2016/0215782 | A1* | 7/2016 | Xie | F04D 29/441 |
| 2017/0130726 | A1* | 5/2017 | Qin | F21S 6/002 |
| 2017/0205082 | A1* | 7/2017 | Kim | F24F 1/0047 |
| 2018/0180052 | A1* | 6/2018 | Niemiec | F04D 25/088 |
| 2019/0072288 | A1* | 3/2019 | Niemiec | F21V 33/0096 |
| 2019/0234423 | A1* | 8/2019 | Schaafsma | F04D 29/547 |
| 2019/0242391 | A1* | 8/2019 | Whitmire | F04D 29/601 |
| 2020/0173646 | A1* | 6/2020 | Marinus | F24F 1/0287 |

* cited by examiner

COMBINED LAMP AND BLADELESS FAN

CROSS-REFERENCE TO RELATED APPLICATIONS

This application is based upon and claims the priority of PCT patent application No. PCT/CN2019/096413 filed on Jul. 17, 2019 which claims priority to the Chinese patent application No. 201810821894.9 filed on Jul. 24, 2018 and the Chinese patent application No. 201821178486.8 filed on Jul. 24, 2018, the entire content of all of which is hereby incorporated by reference herein for all purposes.

TECHNICAL FIELD

The present disclosure relates to a technical field of lighting, and particularly, to a lamp.

BACKGROUND

A lamp and a bladeless fan serve as common household appliances, the lamp is capable of lighting, while the bladeless fan is capable of generating continuous wind and is not provided with blades so as not to be covered with dust or injure fingers of children, thereby becoming more popular among broad users.

However, as two independent products in the related art, the lamp and the bladeless fan are required to be disposed alone on different positions in a house, so that more indoor space is occupied.

SUMMARY

The present disclosure provides a lamp.

According to a first aspect of the present disclosure, a lamp is provided. The lamp includes an air supply and a lighting module. The air supply includes an air blower and an annular housing. The annular housing defines an annular region and has an inner ring surface, an outer ring surface, a first end surface, and a second end surface. The first end surface and the second end surface are connected with the inner ring surface and the outer ring surface and face away from each other. An annular air passage is disposed inside of the annular housing. An air inlet communicates with the annular air passage and is disposed in the inner ring surface. The air blower is located in the annular region. A first air outlet of the air blower is aligned to the air inlet. A second air outlet communicates with the annular air passage and is disposed in the annular housing. The second air outlet blows out air towards a side faced by the first end surface.

The lighting module is disposed at a side of the annular housing. The side is close to the first end surface and is located within a projection range of the annular region at the side. And the lighting module emits light rays towards the side faced by the first end surface. The air supply includes a tray located in the annular region, and the tray is fixed on the air blower and directly fixed to the lighting module.

It is to be understood that both the foregoing general description and the following detailed description are exemplary and explanatory only and are not restrictive of the present disclosure.

BRIEF DESCRIPTION OF THE DRAWINGS

The accompanying drawings herein are used for providing further understanding of the present disclosure, and constitute a portion of the present disclosure, and the illustrated embodiments of the present disclosure and the description thereof are used for explaining the present disclosure and are not limitative of the present disclosure. In the accompanying drawings.

DETAILED DESCRIPTION

Figure 1:
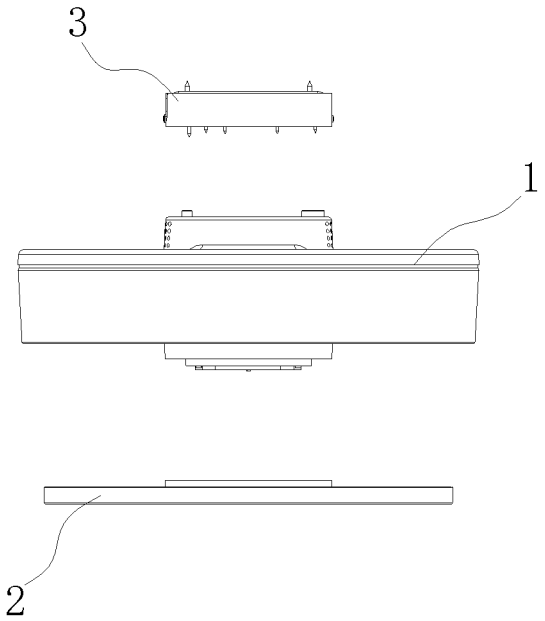
FIG. 1 is an assembly view of a main structure of a lamp disclosed in an embodiment of the present disclosure.

In order to make objects, technical solutions and advantages of the embodiments of the present disclosure apparent, the technical solutions of the embodiment will be described in a clearly and fully understandable way in connection with the embodiments and the corresponding drawings of the present disclosure. It is obvious that the described embodiments are just a part but not all of the embodiments of the present disclosure. Based on the described embodiments herein, those skilled in the art can obtain other embodiment(s), without any inventive work, which should be within the scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Detailed description will be given below to the technical solutions provided by the embodiments of the present disclosure, with reference to the accompanying drawings.

Description of reference numerals used in this disclosure may include:

1—air supply module, 10—air blower, 100—air outlet of air blower, 11—annular housing; 11*a*—inner ring surface, 11*b*—outer ring surface, 11*c*—first end surface, 11*d*—second end surface, 110—upper housing, 112—lower housing, 12—annular region, 13—annular air passage, 14—air inlet, 15—air outlet, 16—tray, 160—insertion groove, 17—upper cover, 170—gas inlet, 18—accommodating chamber, 2—lighting module, 20—light emitting component, 21—fixing part, 22—light guide component, 23—light transmitting plate, 230—light incident surface, 232—light exiting surface, 24—protective jacket; 3—ceiling plate, 4—driving module, 5—bolt, and 6—backing plate.

An embodiment of the present disclosure discloses a lamp, as shown in FIG. 1 to FIG. 5, which includes an air supply module 1 and a lighting module 2, and generally, the lamp may further include a ceiling plate 3 and a driving module 4.

The air supply module 1 is used for continuously producing a blowing air flow to function as a bladeless fan. Specifically, as shown in FIG. 2 to FIG. 5, the air supply module 1 includes an air blower 10 and an annular housing 11. The annular housing 11 defines an annular region 12 and has an inner ring surface 11*a*, an outer ring surface 11*b* as well as a first end surface 11*c* and a second end surface 11*d* which are connected with the inner ring surface 11*a* and the outer ring surface 11*b* and face away from each other. In the present embodiment, the first end surface 11*c* and the second end surface 11*d* respectively face two sides of the lamp which faces away from each other, wherein a side faced by the second end surface 11*d* is generally a wall or ceiling when the lamp is in a use state, while a side faced by the first end surface 11*c* refers to a region facing away from the wall or ceiling on the lamp when the lamp is in the use state, that is, a working range of the lamp, and both the lighting and air outlet directions of the lamp are towards such a range. An inside of the annular housing 11 is provided with an annular air passage 13, the inner ring surface 11*a* is provided with an air inlet 14 communicating with the annular air passage 13, the air blower 10 is located in the annular region 12, an air outlet 100 of the air blower 10 is aligned to the air inlet 14; the annular housing 11 is further provided with an air outlet 15 communicating with the annular air passage 13, and wind or air is blown out from the air outlet 15 to a side faced by the first end surface 11*c*.

When the air blower 10 is started, air may be continuously drawn in and taken out through the air outlet 100 of the air blower 10 in a form of air flow, and the air flow may enter the air inlet 14 after leaving from the air outlet 100 of the air blower 10 and enter the annular air passage 13 along the air inlet 14. The air flow may be annularly delivered to each position by the annular air passage 13 and then blown from the air outlet 15 to the side faced by the first end surface 11*c*. These blown air flows may be blown to the right front of the first end surface 11*c* or blown at a relatively inclined angle.

The air outlet 15 may extend in a circumferential direction of the annular housing to form a narrow opening so as to increase flow rate of the air flow. In order to ensure that the air flow is relatively uniformly distributed in the circumferential direction, the plurality of air outlets 15 may be simultaneously arranged in the circumferential direction of the annular housing 11.

Moreover, on this basis, different air outlet effects may be further achieved in a way of changing directions of these air outlets 15 in the present embodiment. For example, a portion or all of the air outlets 15 may be inclined towards a center of the annular housing 11, in this way, the air flows blown out from these air outlets 15 may be shifted towards the center of the annular housing 11, so that wind power on a central position of the lamp is strengthened. Or, a portion or all of the air outlets 15 may be inclined towards a periphery of the annular housing 11, in this way, the air flows blown out from these air outlets 15 may have greater offsets, so that the blowing range of the lamp is widened.

Of course, in some embodiments, the air outlet 15 inclined towards the center of the annular housing 11 and the air outlet inclined towards the periphery of the annular housing 11 may also be provided at the same time, and even, the air outlet 15 disposed towards the right front may be provided at the same time. These kinds of air outlets 15 are matched with each other to achieve more complex and variable air outlet effect, so that user experience is improved.

In the present embodiment, the air outlet 15 may be disposed in the inner ring surface 11*a*, the outer ring surface 11*b* or the first end surface 11*c* of the annular housing 11. However, compared with a solution in which the air outlet 15 is disposed in the first end surface 11*c*, a solution in which the air outlet 15 is disposed in the inner ring surface 11*a* or the outer ring surface 11*b* has a certain limitation in terms of air outlet angle. If the air outlet 15 is disposed in the first end surface 11*c*, the above-mentioned problem may be avoided. Moreover, at the moment, a shape of the annular air passage 13 may be designed to taper from a side close to the second end surface 11*d* to a side close to the first end surface 11*c*, in this way, the air flow may be gradually accelerated when flowing to the air outlet 15 in the first end surface 11*c*, so that air flow with a higher initial speed may be obtained.

In the present embodiment, the air inlet 14 may protrude towards an inside of the annular region 12 to form an air flow passage. In this way, on one hand, a position of the air blower 10 may be selected more flexibly, and it is unnecessary to cling the air blower 10 to the annular housing 11. For example, at the moment, the air blower 10 may be disposed on a central position of the annular region 12 to ensure that a center of gravity of the air supply module 1 is closer to a structural center, thereby being beneficial to the improvement of structural stability. On the other hand, the protruded air inlet 14 may also play certain roles in carding and guiding the air flows to ensure that there is sufficient space for the air flow to change from flowing appropriately along an radial direction at the moment of entering the air inlet 14 to flowing along the circumferential direction inside the annular air passage 13, so that the loss of kinetic energy is reduced. The air inlet 14 may be smoothly connected with the annular air passage 13 to further reduce wind resistance.

Figure 2:
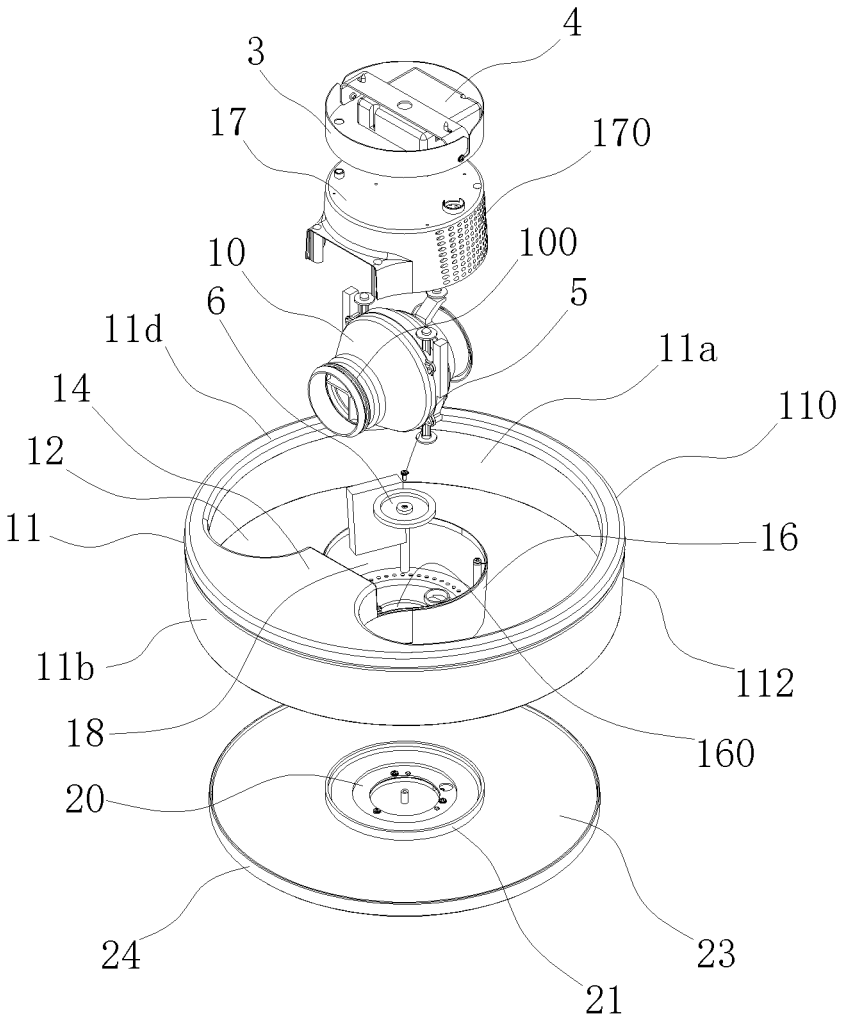
FIG. 2 is an exploded view of a lamp disclosed in an embodiment of the present disclosure.
Figure 3:
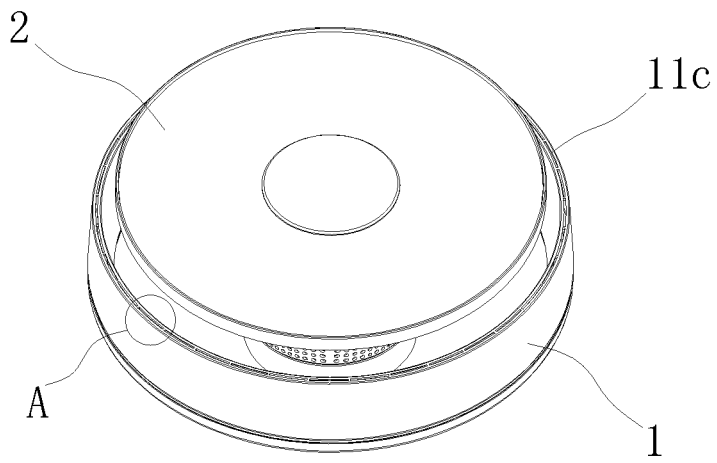
FIG. 3 is a bottom perspective view of a lamp disclosed in an embodiment of the present disclosure.
Figure 4:
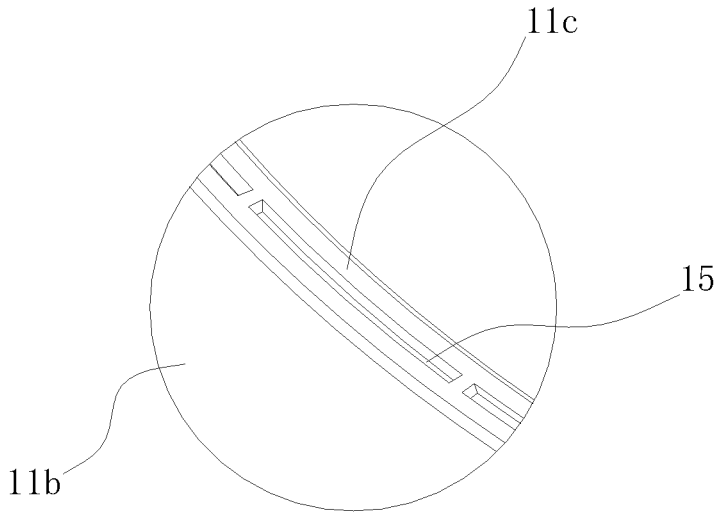
FIG. 4 is a partial enlarged view of a portion A in FIG. 3.
Figure 5:
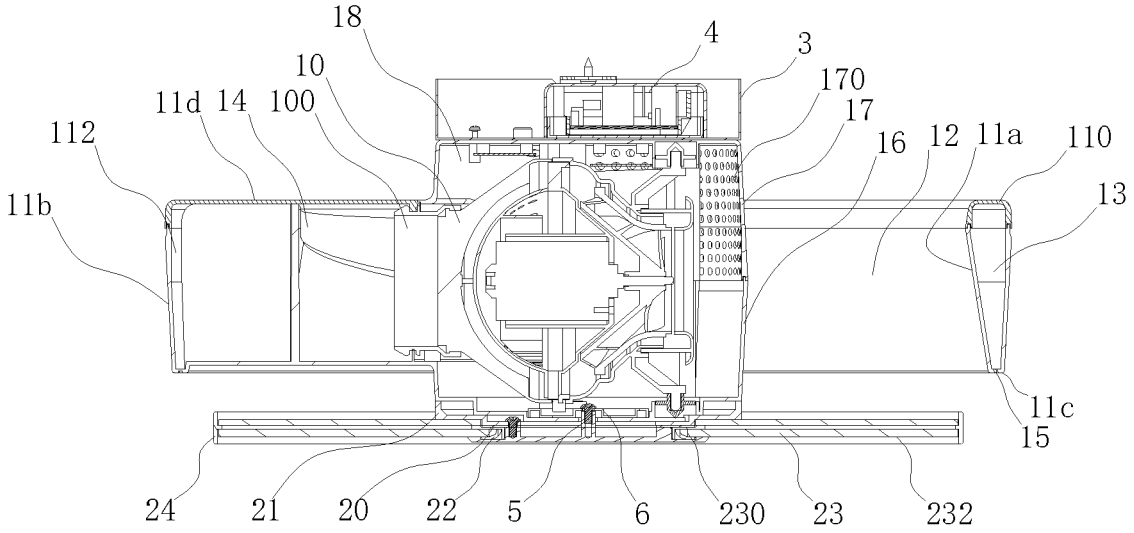
FIG. 5 is a cross-sectional view of the lamp along an air inlet in an embodiment of the present disclosure.

In order to fix the air blower 10, the air supply module 1 in the present embodiment may further include a tray 16, the tray 16 is located in the annular region 12 and is fixedly connected with the annular housing 11, and the air blower 10 is fixedly disposed on the tray 16. In the present embodiment, the tray 16 may be assembled separately with the annular housing 11, or integrated with the annular housing 11. For example, as shown in FIG. 2 and FIG. 5, in order to simplify a forming process and reduce the cost, the annular housing 11 may include two parts, that is, an upper housing 110 and a lower housing 112, the annular air passage 13 is defined together by the upper housing 110 and the lower housing 112, wherein the first end surface 11*c* is located on the lower housing 112, the second end surface 11*d* is located on the upper housing 110, and at the moment, the tray 16 may be integrated with the lower housing 112. In this way, a process of mounting the tray 16 separately may be omitted during assembly.

In order to more comprehensively protect the air blower 10, the air supply module 1 in the present embodiment may further include an upper cover 17, the upper cover 17 covers the tray 16 and forms an accommodating chamber 18 together with the tray 16, and the air blower 10 is disposed in the accommodating chamber 18. In order to ensure that air may normally enter the air blower 10, the upper cover 17 and/or the tray 16 is required to be provided with a gas inlet 170. When the tray 16 is integrated with the lower housing 112, it is greatly difficult to dispose the gas inlet 170 in the lower housing 112, the cost is relatively high, and therefore, at the moment, the upper cover 17 may be provided with the gas inlet 170 individually.

Further referring to FIG. 1 to FIG. 5, the lighting module 2 in the present embodiment is disposed at a side of the annular housing 11 which is close to the first end surface 11*c*, and in order not to hinder blowing, the lighting module 2 is required to be located within a projection range of the annular region 12 at the side. During use, the lighting module 2 may emit light ray to a direction faced by the first end surface 11*c*, that is, a lighting direction of the lamp is consistent with a blowing direction.

The ceiling plate 3 is used for fixing the lamp. Specifically, the ceiling plate 3 is fixedly disposed on the ceiling or wall, the air supply module 1 is fixedly disposed on the ceiling plate 3 in a way that the first end surface 11*c* faces away from the ceiling plate 3. The lighting module 2 may be fixedly disposed on the air supply module 1 or fixedly connected with the ceiling plate 3 after directly penetrating through the annular region 12. The driving module 4 may be disposed inside the ceiling plate 3 and electrically connected with the air blower 10 and the lighting module 2, and the driving module 4 may control a rotating speed of the air blower 10 so as to further regulate the wind volume. In addition, the driving module 4 may automatically regulate and control light and color of the lighting module 2, for example, a sensor may be disposed to sense change of ambient light, sound or temperature, and when the ambient light is monitored to be reduced or obvious sound is monitored, the driving module 4 may control the lighting module 2 to improve the light intensity so as to provide lighting for an environment. Besides, a receiving module may also be disposed to receive control signals from a remote controller, a mobile phone and the like, and the driving module 4 controls the air blower 10 and the lighting module 2 according to these control signals.

The lighting module 2 is disposed at the side of the annular housing 11 which is close to the first end surface 11*c* and is relatively far from the ceiling plate 3 so as to be preferably fixed on the air supply module 1. The lighting module 2 may be fixed with the annular housing 11, and when the air supply module 1 is provided with the tray 16, the lighting module 2 may also be fixe to the tray 16.

Specifically, the tray 16 may be connected and fixed with the lighting module 2 by using a bolt 5, and the bolt 5 may be disposed separately or integrated with the tray 16 or the lighting module 2. Moreover, the bolt 5 may be matched with a nut or a threaded hole. In order to guarantee higher stability of the bolt 5, a backing plate 6 is further disposed in the present embodiment, a surface of a side facing the air blower 10 of the tray 16 is provided with an insertion groove 160, the backing plate 6 is disposed into the insertion groove 160, and the bolt 5 penetrates through and abuts with the backing plate 6. By using the backing plate 6, the bolt 5 may achieve a stable abutting surface, so that the connection stability of the bolt 5 is improved, and shaking is reduced.

The lighting module 2 in the present embodiment may adopt various structures, for example, a light emitting component 20 is matched with a lens and a mask to form a ceiling lamp structure, or a reflector may also be additionally disposed as required to form a spot lamp structure, and even, a traditional bulb may be adopted. That is, there are no limitations on the structure of the lighting module 2 in the present embodiment.

In consideration of the reduction of overall thickness of the lamp, the lighting module 2 preferably adopts a structure with relatively small thickness. For example, the lighting module 2 may include a light emitting component 20, a fixing part 21, a light guide component 22 and a light transmitting plate 23, wherein the fixing part 21 is a main structure of the lighting module 2 and is used for fixing other components and also fixing the overall lighting module 2 and other structures. The fixing part 21 may be made of a metal material with relatively high strength, both the light emitting component 20 and the light guide component 22 are fixedly disposed in the fixing part 21, a direction of the light emitting component 20 is consistent with a direction of the first end surface 11*c* and the light emitting component 20 is used for emitting light ray to the side faced by the first end surface 11*c*. Generally, the lighting module may distribute light for the light emitting component 20 by adopting a lens and a light transmitting cover, but the lens and the light transmitting cover are required to be disposed in the front of the light emitting component 20, and therefore, a thickness of the lighting module may be greatly increased. In the present embodiment, the light guide component 22 and the light transmitting plate 23 are used as light distribution elements. Specifically, the light transmitting plate 23 extends in a direction parallel to the first end surface 11*c*, and a part of the light transmitting plate 23 extends into the fixing part 21 and is fixed with the fixing part 21.

The light transmitting plate 23 is provided with a light incident surface 230 and a light exiting surface 232, wherein a direction of the light exiting surface 232 is consistent with a direction of the first end surface 11*c*, and the light incident surface 230 is vertical to the light exiting surface 232. The light guide component 22 is used for guiding the light ray emitted by the light emitting component 20 to the light incident surface 230, and the light guide component 22 may guide light by adopting an arc-shaped reflecting surface or other ways. After entering the light transmitting plate 23, these light rays may be propagated in an extension direction of the light transmitting plate 23 and emitted out from the light exiting surface 232. The light guide component 22 in the present embodiment and the light transmitting plate 23 are matched to be substantially arranged in parallel, and therefore, the thickness of the lighting module 2 may be effectively reduced.

In the present embodiment, the light transmitting plate 23 may be made of a unilateral semitransparent material such as a mirror, in this way, it is impossible for a user to view a rear of the light transmitting plate 23 via the light transmitting plate 23. However, in some embodiments, the light transmitting plate 23 may also be made of a completely transparent material such as glass, in this way, the user may directly view a structure at the rear via the light transmitting plate 23, and thus, the lamp has different appearance effects. However, if the light transmitting plate is made of the completely transparent material, it is possible that the light rays are emitted out from the surface of a side of the light transmitting plate 23 which faces away from the light exiting surface 232, thereby lowering the light intensity. Therefore, the surface of the side of the light transmitting plate 23 which faces away from the light exiting surface 232 may be provided with a plurality of silk screen points or laser code points for reflecting the light rays. The light rays may be reflected to the light exiting surface 232 by using the silk screen points or laser code points, thereby improving the light intensity. The silk screen points or laser code points may be arranged in various shapes such as a radial, annular or spiral shape.

In the present embodiment, the light transmitting plate 23 may be of various shapes such as a rectangle and a sector, while an annular light transmitting plate 23 may achieve the maximum area and a relatively uniform lighting range, and therefore, the light transmitting plate 23 in the present embodiment is recommended to adopt an annular structure, the fixing part 21 is located in the middle of the annular structure, and an inner side of the light transmitting plate 23 extends into the fixing part 21. Now, in order to protect the light transmitting plate 23, an outer side of the light transmitting plate 23 may be surrounded by a circle of protective jacket 24 for protection.

At least one of the above-mentioned technical solutions adopted in the embodiments of the present disclosure may achieve the following beneficial effects:

The lamp disclosed by the embodiments of the present disclosure is capable of simultaneously having lighting and air outlet functions and is greatly reduced in terms of volume as comparison with a combination of an independent lamp and a bladeless fan, and therefore, the indoor space may be saved.

According to a first aspect of the present disclosure, a lamp is provided. The lamp includes an air supply and a lighting module. The air supply includes an air blower and an annular housing. The annular housing defines an annular region and has an inner ring surface, an outer ring surface, a first end surface, and a second end surface. The first end surface and the second end surface are connected with the inner ring surface and the outer ring surface and face away from each other. An annular air passage is disposed inside of the annular housing. An air inlet communicates with the annular air passage and is disposed in the inner ring surface. The air blower is located in the annular region. A first air outlet of the air blower is aligned to the air inlet. A second air outlet communicates with the annular air passage and is disposed in the annular housing. The second air outlet blows out air towards a side faced by the first end surface.

The lighting module is disposed at a side of the annular housing. The side is close to the first end surface and is located within a projection range of the annular region at the side. And the lighting module emits light rays towards the side faced by the first end surface.

In one embodiment, the second air outlet extends along a circumferential direction of the annular housing.

In one embodiment, the lamp further includes one or more second air outlets are provided, and all the second air outlets are arranged along the circumferential direction of the annular housing.

In one embodiment, at least some of the second air outlets are inclined towards a center of the annular housing, and/or, at least some of the second air outlets are inclined towards a periphery of the annular housing.

In one embodiment, the second air outlet is disposed in the first end surface.

In one embodiment, the annular air passage tapers from a side close to the second end surface to a side close to the first end surface.

In one embodiment, the air inlet protrudes towards inside of the annular region, and the air inlet is smoothly connected with the annular air passage.

In one embodiment, the air supply further includes a tray, the tray is located in the annular region and is fixedly connected with the annular housing, and the air blower is fixed on the tray.

In one embodiment, the annular housing includes an upper housing and a lower housing, the annular air passage is defined together by the upper housing and the lower housing, the first end surface is located on the lower housing, the second end surface is located on the upper housing, and the tray is integrated with the lower housing.

In one embodiment, the air supply further includes an upper cover, the upper cover covers the tray and forms an accommodating chamber together with the tray, the air blower is disposed in the accommodating chamber, and a gas inlet is disposed on the upper cover and/or the tray.

In one embodiment, the lighting module is fixed to the tray.

In one embodiment, the lamp further includes a backing plate, an insertion groove is disposed on a surface of a side facing the air blower of the tray, the backing plate is disposed inside the insertion groove, and a bolt penetrates through and abuts with the backing plate.

In one embodiment, the lighting module includes a fixing part and a lighting emitting component, the fixing part is fixedly connected with the air supply, and the light emitting module is fixed on the fixing part.

In one embodiment, the lamp further includes a light guide component and a light transmitting plate, the light guide component is fixedly disposed in the fixing part, a direction of the light emitting component is consistent with a direction of the first end surface, the light transmitting plate extends in a direction parallel to the first end surface, a portion of the light transmitting plate extends into the fixing part and is fixed with the fixing part, the light transmitting plate includes a light incident surface and a light exiting surface, a direction of the light exiting surface is consistent with a direction of the first end surface, the light incident surface is vertical to the light exiting surface, and the light guide component is configured to guide light rays emitted by the light emitting component to the light incident surface.

In one embodiment, the light transmitting plate is made of a transparent material, and a plurality of silk screen points are disposed on a surface of a side facing away from the light exiting surface of the light transmitting plate, and the plurality of silk screen points reflect the light rays.

In one embodiment, the light transmitting plate is annular, and an inner side of the light transmitting plate extends into the fixing part.

In one embodiment, the lighting module further includes a protective jacket, and the projective jacket surrounds and covers an outer side of the light transmitting plate.

In one embodiment, the lamp further includes a ceiling plate, the air supply is fixedly disposed on the ceiling plate.

In one embodiment, the lamp further includes a driving module, the driving module is disposed in the ceiling plate and is electrically connected with the air blower and the lighting module.

In one embodiment, the lamp further includes a sensor and/or a receiving module, the sensor and/or the receiving module is electrically connected with the driving module.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above examples of the application focus on the differences between the examples. The different optimization features between the examples can be combined to form a better example as long as the different optimization features between the examples are not contradictory, which will not be repeated here for conciseness.

What are described above is related to the examples of the present disclosure only and not limitative to the present disclosure. Various modification and change may be made by those skilled in the art. Any modification, equivalent replacement and modification made within the spirit and principle of the present disclosure are regarded as falling within the protection scope of the present disclosure.

What is claimed is:

1. A lamp, comprising:

an air supply comprising an air blower and an annular housing, the annular housing defining an annular region and having an inner ring surface, an outer ring surface, a first end surface, and a second end surface, wherein the first end surface and the second end surface are connected with the inner ring surface and the outer ring surface and face away from each other, an annular air passage is disposed inside of the annular housing, an air inlet communicates with the annular air passage and is disposed in the inner ring surface, the air blower is located in the annular region, a first air outlet of the air blower is aligned to the air inlet, a second air outlet communicates with the annular air passage and is disposed in the annular housing, and the second air outlet blows out air towards a side faced by the first end surface; and a lighting module disposed at a side of the annular housing, wherein the side is close to the first end surface and located within a projection range of the annular region at the side, and the lighting module emits light rays towards the side faced by the first end surface, wherein the lighting module comprises a fixing part and a lighting emitting component, the fixing part is fixedly connected with the air supply, and the light emitting module is fixed on the fixing part; and a light guide component and a light transmitting plate, wherein the light guide component is fixedly disposed in the fixing part, a direction of the light emitting component is consistent with a direction of the first end surface, the light transmitting plate extends in a direction parallel to the first end surface, a portion of the light transmitting plate extends into the fixing part and is fixed with the fixing part, the light transmitting plate comprises a light incident surface and a light exiting surface, a direction of the light exiting surface is consistent with a direction of the first end surface, the light incident surface is vertical to the light exiting surface, and the light guide component is configured to guide light rays emitted by the light emitting component to the light incident surface.

2. The lamp according to claim 1, wherein the second air outlet extends along a circumferential direction of the annular housing.

3. The lamp according to claim 2, further comprising one or more second air outlets, and all the second air outlets are arranged along the circumferential direction of the annular housing.

4. The lamp according to claim 3, wherein at least some of the second air outlets are inclined towards a center of the annular housing, or at least some of the second air outlets are inclined towards a periphery of the annular housing.

5. The lamp according to claim 1, wherein the second air outlet is disposed in the first end surface.

6. The lamp according to claim 5, wherein the annular air passage tapers from a side close to the second end surface to a side close to the first end surface.

7. The lamp according to claim 1, wherein the air inlet protrudes towards inside of the annular region, and the air inlet is smoothly connected with the annular air passage.

8. The lamp according to claim 1, wherein the air supply further comprises a tray, the tray is located in the annular region and is fixedly connected with the annular housing, and the air blower is fixed on the tray.

9. The lamp according to claim 8, wherein the annular housing comprises an upper housing and a lower housing, the annular air passage is defined together by the upper housing and the lower housing, the first end surface is located on the lower housing, the second end surface is located on the upper housing, and the tray is integrated with the lower housing.

10. The lamp according to claim 8, wherein the air supply further comprises an upper cover, the upper cover covers the tray and forms an accommodating chamber together with the tray, the air blower is disposed in the accommodating chamber, and a gas inlet is disposed on the upper cover or the tray.

11. The lamp according to claim 8, wherein the lighting module is fixed to the tray.

12. The lamp according to claim 11, further comprising a backing plate, wherein an insertion groove is disposed on a surface of a side facing the air blower of the tray, the backing plate is disposed inside the insertion groove, and a bolt penetrates through and abuts with the backing plate.

13. The lamp according to claim 3, wherein the tray is directly fixed to the lighting module.

14. The lamp according to claim 8, wherein at least some of the second air outlets are inclined towards a center of the annular housing, and at least some of the second air outlets are inclined towards a periphery of the annular housing.

15. The lamp according to claim 14, wherein the light transmitting plate is made of a transparent material, a plurality of silk screen points are disposed on a surface of a side facing away from the light exiting surface of the light transmitting plate, and the plurality of silk screen points reflect the light rays.

16. The lamp according to claim 14, wherein the light transmitting plate is annular, and an inner side of the light transmitting plate extends into the fixing part.

17. The lamp according to claim 16, wherein the lighting module further comprises a protective jacket, and the projective jacket surrounds and covers an outer side of the light transmitting plate.

18. The lamp according to claim 1, further comprising a ceiling plate, wherein the air supply is fixedly disposed on the ceiling plate.

19. The lamp according to claim 18, further comprising a driving module, wherein the driving module is disposed in the ceiling plate and is electrically connected with the air blower and the lighting module.

20. The lamp according to claim 19, further comprising a sensor or a receiving module, wherein the sensor or the receiving module is electrically connected with the driving module.

* * * * *